United States Patent [19]

Laendler

[11] Patent Number: 4,934,082

[45] Date of Patent: Jun. 19, 1990

[54] REVOLVERS

[75] Inventor: Istvan J.-K. D. C. Laendler, Johannesburg, South Africa

[73] Assignees: Lawrence Haar; John Galgut, both of Scottsdale, Ariz.

[21] Appl. No.: 281,776

[22] Filed: Dec. 9, 1988

[30] Foreign Application Priority Data

Dec. 8, 1986 [ZA] South Africa ..... 86/6040

[51] Int. Cl.[5] ..... F41C 1/00; F42B 39/00

[52] U.S. Cl. ..... 42/68; 42/89

[58] Field of Search ..... 42/89, 68

[56] References Cited

U.S. PATENT DOCUMENTS

| | | | |
|---|---|---|---|
| 684,752 | 10/1901 | Garfield et al. | 42/89 |
| 881,437 | 3/1908 | Neal | 42/89 |
| 923,068 | 5/1909 | Neal | 42/89 |
| 1,202,342 | 10/1924 | Wesson | 42/89 |
| 1,202,343 | 10/1916 | Wesson et al. | 42/89 |
| 1,231,106 | 6/1917 | Wesson | 42/89 |
| 1,258,170 | 4/1918 | Wesson | 42/89 |
| 3,722,125 | 4/1973 | Switzer | 42/89 |
| 3,744,171 | 7/1973 | Fecke | 42/89 |
| 3,874,104 | 4/1975 | Sibley | 42/68 |
| 4,535,558 | 8/1985 | Benesh | 42/89 |

FOREIGN PATENT DOCUMENTS

| | | | |
|---|---|---|---|
| 3107729 | 8/1982 | Fed. Rep. of Germany | 42/89 |
| 827325 | 4/1938 | France | 42/89 |
| 776188 | 10/1978 | South Africa | 42/89 |

*Primary Examiner*—Deborah L. Kyle
*Assistant Examiner*—Michael J. Carone

[57] ABSTRACT

The cylinder of a revolver has a recess in its rear face through which the chambers pass and which is surrounded by a shoulder. In the base of this recess is a second recess in which is received an extractor star carried by the ejector rod and itself carrying a cylindrical member having the ratchet thereon. Within the first recess there is a steel clip which carries the cartridges. The clip is of substantially the same thickness as the depth of the recess, and has a plurality of arms radiating from the central portion to form generally circular openings each subtending an angle in excess of 180° at its centre. Each arm is split along a line running substantially radially of the central portion to permit the arm to flex for the purpose of inserting the cartridges into the openings.

11 Claims, 1 Drawing Sheet

REVOLVERS

This invention relates to revolvers.

BACKGROUND TO THE INVENTION

Revolvers are very popular firearms particularly with law enforcement officers. They are convenient to use and economical to make and persons can be trained to use them relatively easily. A major problem with revolvers however arises from the the fact that they are slow and clumsy to reload in comparison with automatic pistols. This can be of very serious effect when a person using the firearm is under stress or under fire.

A number of suggestions have been made to improve the manner in which revolvers can be reloaded. A very popular device for this purpose is that which is the subject of U.S. Pat. No. 3,722,125 (Switzer). This device comprises a loader having apertures to receive the rear ends of cartridges and an operating member that engages the rims of the cartridge cases to hold them in the loader. The operating member is actuated by manipulation of a control knob. On reverse manipulation of the control knob, which normally takes place when the front ends of the cartridges are inserted into the chambers of the revolver cylinder, the device releases the cartridges. The user will now remove the device and by hand home the cartridges into the chambers. Because the device must receive the rims of the cartridge cases, the apertures must perforce be of larger diameter than the body of the cartridge cases and the cartridges are therefore loosely held in the device. This means that in practice the device can normally only be used with the revolver pointed downwardly. The construction of the device is such that cartridges cannot be fully homed into the chambers whilst still held by the device. The foregoing means that the user must practise before adequate skill in using the device is acquired. The operation of the device, although an improvement over hand loading, is rather slow. Further the device does not retain the spent cartridge cases during ejection from the chambers. Additionally this device is rather expensive and will not normally be discarded after use.

Another device has been used for holding rimless cartridges (such as .45 ACP cartridges, which in practice is the only size of cartridge that the device can accomodate) to enable them to be used in a revolver. This device is known as the "half moon clip". It comprises a half annulus having inwardly directed arms that engage in the grooves in three cartridges and hold them firmly for insertion in the chambers. Two half moon clips are required for loading a six chamber revolver. Although this device is very satisfactory for use as a converter, it cannot be used as a loading clip for rimmed cartridges designed for the weapon because of its thickness when combined with the thickness of the rim would be too great to be accommodated between the rear end of the cylinder and the standing breech and the cylinder could not be locked into the firing condition.

Another device apparently on the market is that known as a full moon clip. This has a central portion from which radiate solid arms that define between them apertures into which the rear ends of cartridges may be received. This device apparently operates in the same way as a half moon clip with most if not all the limitations of that device.

Various loading strip arrangements are known. These too improve loading times but remain slow and tedious in operation.

An improvement made by me is described in my South African Patent Specification No 77/6188. In this specification, I described a clip having an inner annulus from which radiated spring arms that define a number of apertures corresponding to the number of chambers in the cylinder of the revolver with which the clip was to be used. The clip was of the same thickness as the extractor star, being of the order of 1,8 mm in thickness, and, to accommodate it, the rear end of the cylinder required fairly extensive modification. First, the end face had to be recessed to receive the clip therein. Second, the extractor star had to be removed to accommodate the thickness of the clip. Third, the ratchet was provided with a frusto-conical surround to engage a correspondingly frusto-conical central aperture in the clip in order to move the clip rearwardly to eject the cartridges held by it.

A shoulder left around the recess to engage the rims of cartridges inserted into the chambers when not carried by the clip. However, in such circumstances, the revolver could not eject the spent cases of such individually loaded cartridges.

SUMMARY OF THE INVENTION

According to an aspect of the present invention there is provided the combination of a cylinder of a revolver with a clip holding a plurality of cartridges, wherein:-

(a) the cylinder comprises (a.1) a recess in its rear face which is surrounded by a shoulder, (a.2) an ejector rod, (a.3) chambers passing through the cylinder and respectively receiving the said cartridges, each said chamber opening partially through the said recess and partially through said shoulder, (a.4) an extractor star which is carried by the ejector rod at its rear end and which is let into the base of the recess, and (a.5) a cylindrical member carried on the rear of the extractor star and having a ratchet thereon;

and wherein:

(b) the clip (b.1) consists of a resilient material, (b.2) is of substantially the same thickness as the depth of the recess, and comprises (b.3) a central portion having an aperture therein through which the said cylindrical member can freely pass, and (b.4) a plurality of arms radiating from the central portion to form generally circular openings in which the said cartridges are received each subtending an angle in excess of 180° at its centre, at least the outer portion of each arm being split along a line running substantially radially of the central portion to permit the arm to flex for the purpose of inserting the cartridges into the openings. The invention also provides in another aspect the above combination with a plurality of rimmed cartridges held by the clip and received respectively in the chambers.

According to another aspect of the invention there is provided a method of modifying a revolver having (i) a cylinder with chambers therethrough and a rear surface with a star recess therein and (ii) an ejector star received in the star recess, the star comprising a plate part and a central boss, the method comprising the step of (a) forming in the rear base of the cylinder a depression which is less deep than the star recess and which is surrounded by a shoulder that lies alongside the chambers; and (b) removing material from the plate part of the ejector star so that the thickness of the plate part is equivalent to the difference in depth between the said depression and the star According to a further aspect of the present invention there is provided a cylinder of a revolver having a plurality of chambers therethrough, a first recess in the rear face of the cylinder surrounded by a shoulder, a second recess formed in the base of the main recess and an extractor star received in the second recess and having its outer surface substantially flush with the base of the main recess.

An embodiment of the invention will now be described by way of example with reference to the accompanying drawings.

SHORT DESCRIPTION OF THE DRAWINGS

FIG. 1 is a view of the rear face of the cylinder of a revolver of the invention, FIG. 2 is a perspective view of the rear of the cylinder showing the extractor star in its position after ejecting a clip as well as the clip, FIG. 3 is a detail section on line 2—2 of FIG. 1 showing in addition a clip of the invention carrying a cartridge, and FIG. 4 is a plan of the clip.

DESCRIPTION OF PREFERRED EMBODIMENT OF THE INVENTION

Figure 1:
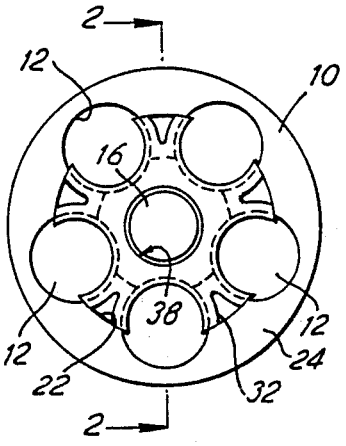
Figure 2:
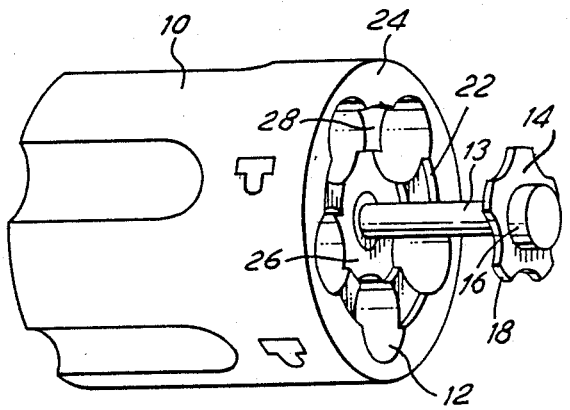
Figure 3:
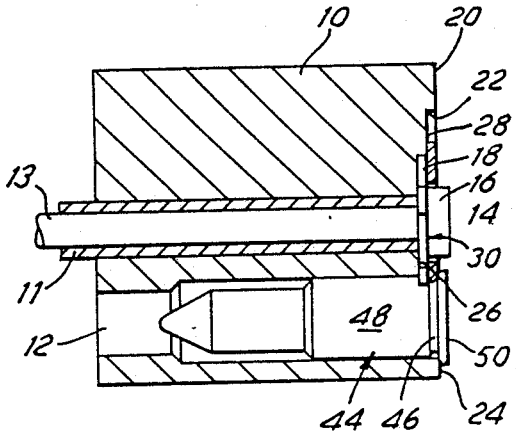
Figure 4:
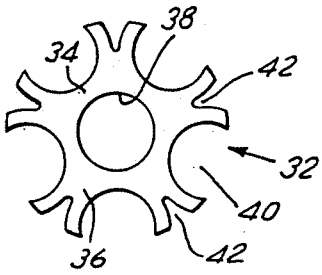

Referring now to the drawings, there is shown the cylinder 10 of a side opening revolver. The cylinder 10 is carried on a cylinder shaft 11 that passes through the cylinder from its forward face end to its rear face. The cylinder 10 has five equispaced chambers 12 therethrough. A central ejector rod 13 is slidably housed in the cylinder shaft and carries at its rear end a ratchet 14 mounted on a cylindrical part 16 which is secured to and forms part of a flat extractor star 18 also secured to the ejector rod 13.

The rear face 20 of the cylinder is provided with a shallow generally circular recess 22 (hereinafter called "the clip recess") which is 0.8 mm deep and is surrounded by the remaining shoulder 24. The circle which is tangential to the outer portions of the chambers 12 is of slightly greater diameter than the recess 22 so that extreme outer portions of the chambers 12 cut into the shoulder 14 and form shallow grooves therein. A second recess 26 (hereinafter called the "star recess") is provided in the base 28 of the clip recess 22 to receive snugly therein the extractor star 18 in such a way that the outer face 30 of the extractor star 18 lies flush with the base 28 of the clip recess 22.

The thickness of the extractor star 18 is less than the thickness of a conventional extractor star, being in the present embodiment 0.8 mm.

The shape is such that it will engage the rims of cartridges received in the chambers 12.

A clip 32, which is of the same thickness as the depth of the clip recess 22, is received in the recess 22. The clip 32 consists of a resilient tempered steel such as EN 42F. The clip 32 comprises a central annular portion 34 and a plurality of identical arms 36 radiating therefrom. A central aperture 38 is formed in the portion 34 and the cylindrical part 16 carrying the ratchet 14 passes freely through this aperture 38.

Each arm 36 is generally "T"-shaped with arcuate sides so as to define with an adjacent arm and the entral portion 34 a cartridge receiving opening 40, there being the same number of clip openings 40 as there are chambers 12. The periphery of each opening is a part of a circle subtending an angle of slightly more than 180° at the centre and having a radius which is slightly smaller than that of the chambers. The clip openings 40 lie equispaced on a pitch circle which is the of the same diameter as that of the chambers of the cylinder 10 and which lies concentric with and wholly within the cylindrical envelope of the clip (that is of course larger than the pitch circle). The location of the openings corresponds to the location of the chambers 12. When the openings 40 register with the chambers, the inner portions of the arms 36 and the central portion 34 will lie over the extractor star 18.

The outer portion of each arm 36 is split by a slot 42 along a line running substantially radially of the central portion 34. The slot 42 terminates in a circular end portion. The provision of this slot 42 permits the arm 36 to flex for the purpose of inserting cartridges into the adjacent opening 40 and thereafter gripping them firmly.

Within each clip opening 40 there is received a rimmed cartridge 44. The cartridges 44 are carried by the clip 32, the arms 36 defining each opening 40 engaging in the groove 46 of the cartridge case 48 and with the outer portion of the rim 50 of cartridge case 48 (which rim is as is well known of greater diameter than the body of the cartridge case) resting on the shoulder 24. The cartridges 44 will thus be surrounded on more than one half of their periphery by the arms 36. Thus they will be firmly and securely held in position by the clip 32 even though the clip 32 is of small thickness, i.e. 0.8 mm, as is apparent from the above.

It will be seen that the head space of the revolver is defined by the distance from the standing breech to the rear face of the shoulder which as is appreciated constitutes the rear face of the cylinder.

It will also be seen that cartridges gripped by the clip 32 will form as it were a magazine for the revolver. Because the cartridges 44 are firmly held, they can be inserted into the chambers 12 quickly and easily irrespective of the angle at which the revolver is being held. As soon as the chambers 12 are loaded, the user has both hands unencumbered for handling and firing the revolver. Furthermore the clip with the spent cases can be removed by the extractor star 18 in the conventional way. It will be noted however that all the spent cases (together with any unfired cartridges) will be removed together and will be held together by the clip 32. Thus no unfired cartridges can remain a chamber in a revolver thought to be unloaded which would constitute a serious danger. Further the spent cartridge cases will not be inadvertently dropped on to the ground.

The clip 32 can further be used as a convertor gripping rimless cartridge cases. In addition, the cylinder 10 can be used with individual rimmed cartridges. The portions of the rims 50 of such cartridges most remote from the central portion will engage the shoulder 24 to limit the depth to which these cartridges can be inserted into the chambers. The cases of these individually loaded cartridges can be removed from the chambers 12 by the extractor star 18 in conventional manner.

The cylinder may be formed initially as described. However it may be formed by recessing the rear face of a conventional cylinder to form the clip recess e.g. by turning, milling or spark erosion. At the same time some of the material of the extractor star will also be removed so that its rear surface will lie flush with the base of the clip surface.

As will have been seen from the above, the revolver of the invention is very versatile, being able to use normal rimmed cartridges and rimless cartridges when using the clip, and in addition normal rimmed cartridges without the clip.

I have found that the extractor star although of reduced thickness operates properly and is of sufficient strength for normal use. The clips can be inexpensively made and can be used repeatedly. The clips can be pre-loaded in the factory, or by hand at home or in the field.

The invention is not limited to the precise constructional details hereinbefore described and illustrated in the drawings but is to be determined only by the scope of the annexed claims. Thus for example should the revolver cylinder have a different number of chambers, then the clip will have a corresponding number of recesses. The thickness of the clip may vary but not by too great an extent, the limitations being imposed by (a) the stiffness of the clip and (b) the width of the groove under the rim or, in the case of rimless cartridges, the requirement of leaving sufficient thickness of the extractor star.

I claim:

1. The combination of a cylinder of a revolver with a clip holding a plurality of cartridges, wherein:

(a) the cylinder comprises
- (a.1) a recess in its rear face which is surrounded by a shoulder,
- (a.2) chambers passing through the cylinder and respectively receiving the said cartridges, each said chamber opening partially through said recess and partially through said shoulder,
- (a.3.) an ejector rod,
- (a.4) an extractor star which is carried by the ejector rod at its rear end and which is let into the base of the recess, and
- (a.5) a cylindrical member carried on the rear of the extractor star and having a ratchet thereon; and wherein:

(b) the clip
- (b.1) consists of a resilient material,
- (b.2) is of substantially the same thickness as the depth of the recess, and comprises
- (b.3) a central portion having an aperture therein through which the said cylindrical member can freely pass, and
- (b.4) a plurality of arms radiating from the central portion to form generally circular openings in which the said cartridges are received, each said opening subtending an angle in excess of 180° at its centre, at least the outer portion of each arm being split along a line running substantially radially of the central portion to permit the arm to flex for the purpose of inserting the cartridges into the openings.

2. The combination as claimed in claim 1 further comprising another recess in the said first mentioned recess, in which other recess the extractor star is received.

3. The combination of claim 1 in which the cartridges are rimmed cartridges, and wherein at least the outermost portion of the rim of each of said cartridge engages said shoulder, which engagement prevents the cartridge moving further into the chamber in which it is received.

4. A cylinder of a revolver having (a) a plurality of chambers therethrough, (b) a rear face in which is formed
- (b.1) a first recess which has a base and through which the said chambers pass and
- (b.2) a shoulder surrounding the first recess, and having part cylindrical grooves therein, the grooves being respectively the part continuations of the chambers, (c) a second recess formed in the base of the said first recess, and (d) an extractor star received in the said second recess and having an outer surface which is substantially flush with the base of the first recess.

5. The combination of a cylinder of a revolver having a plurality of chambers therethrough with a clip holding a plurality of rimmed cartridges which are received respectively in such chambers, wherein:

(a) the cylinder comprises:
- (a.1) a first recess in its rear face, said first recess having a base through which the chambers pass and which is surrounded by a shoulder,
- (a.2) a second recess formed in said base of said first recess,
- (a.3) an ejector rod,
- (a.4) an extractor star which is carried by said ejector rod at its rear, said extractor star being in said second recess and being substantially flush with the said base of said first recess;

and wherein:

(b) the clip
- (b.1) consists of a resilient material,
- (b.2) is of substantially the same thickness as the depth of said first recess, and comprises
- (b.3) a plurality of radial arms which form generally circular openings each subtending an angle in excess of 180° at its centre, at least the outer portion of each arm being split along a line running substantially radially of the central portion to permit the arm to flex for the purpose of inserting the cartridges into the openings; and wherein (c) each said cartridges has
- (c.1) a rim at its rear end and a portion of said rim rests on said shoulder and,
- (c.2) a groove adjacent said rim, said groove being received in one of said openings.

6. The combination as claimed in claim 5 in which the shoulder has a plurality of axial grooves therein, which said grooves are respectively the continuations of the chambers.

7. The combination as claimed in claim 5 in which the said clip has an outer surface that lies substantially flush with the outer surface of the shoulder.

8. A method of modifying a revolver having (i) a cylinder with chambers therethrough and a rear surface with a star-recess therein and (ii) an ejector star received in the star recess, the star comprising a plate part and a central boss, the method comprising the steps of (a) forming in the rear face of the cylinder a depression which is less deep than the star recess and which is surrounded by a shoulder that lies alongside the bores; and (b) removing material from the plate part of the ejector star so that the thickness of the plate part is equivalent to the difference in depth between the said depression and the star recess.

9. A method as claimed in claim 8 comprising forming the said depression by a spark erosion process.

10. A method as claimed in claim 8 comprising removing the material from the said plate part by a spark erosion process.

11. A method as claimed in claim 8 wherein the thickness of the plate part remaining is adequate for the star to be of sufficient strength to be able to remove fired cartridges from the cylinders.

* * * * *